United States Patent [19]

Coker

[11] Patent Number: 5,052,180

[45] Date of Patent: Oct. 1, 1991

[54] FLUID PRESSURE DRIVEN POWER SYSTEM

[75] Inventor: Audie Coker, Las Vegas, Nev.

[73] Assignee: Audie Coker Enterprises, Las Vegas, Nev.

[21] Appl. No.: 655,559

[22] Filed: Feb. 13, 1991

[51] Int. Cl.[5] ..... F16D 31/00; F01D 1/00

[52] U.S. Cl. ..... 60/456; 60/483; 415/124.2; 415/202; 416/197 A

[58] Field of Search ..... 60/983, 456, 453, 454, 60/325; 415/202, 122.1, 124.1, 124.2; 416/197 R, 197 A, 197 B

[56] References Cited

U.S. PATENT DOCUMENTS

| | | | |
|---|---|---|---|
| 768,593 | 8/1904 | Junggren | 290/52 |
| 976,109 | 11/1910 | Wellman | 415/202 |
| 1,140,756 | 5/1915 | Maltby | 415/202 |
| 1,140,952 | 5/1915 | Christensen | 415/202 |
| 1,280,276 | 10/1918 | Morse | 415/202 |
| 1,414,984 | 5/1922 | Hood | 415/122.1 |
| 2,037,538 | 4/1936 | Ritchie | 60/39.31 |
| 2,155,708 | 4/1939 | Hartanov | 415/202 |
| 2,370,526 | 2/1945 | Doran | 60/483 |
| 3,433,014 | 3/1969 | Duport et al. | 60/415 |
| 3,635,576 | 1/1972 | Wieckmann | 415/122.1 |
| 3,879,949 | 4/1975 | Hays et al. | 416/197 R |
| 4,040,272 | 8/1977 | Boyd | 415/124.2 |
| 4,080,787 | 3/1978 | Biggs, Jr. et al. | 415/122.1 |
| 5,001,901 | 3/1991 | Erickson et al. | 60/453 |

FOREIGN PATENT DOCUMENTS

| | | | |
|---|---|---|---|
| 207810 | 11/1955 | Australia | 415/202 |
| 0091705 | 7/1980 | Japan | 415/202 |
| 313450 | 5/1956 | Switzerland | 415/202 |

*Primary Examiner*—Edward K. Look
*Assistant Examiner*—Hoang Nguyen
*Attorney, Agent, or Firm*—Quirk, Tratos & Roethel

[57] ABSTRACT

A fluid pressure driven power system having a plurality of rotors keyed to a shaft rotatably journaled within a casing having, the rotors each having a plurality of fins extending around its periphery with the fins projecting above the perimeter of the rotor. A pressure head mounted within the casing with the casing having a plurality of tubular inserts embedded therein. Each of the tubular inserts having an exposed longitudinal end portion in tangential alignment with the fins on a rotor. Each insert end portion having a cutaway section that is upwardly arcuately compressed to overlie the fins on rotors rotating beneath the pressure head. Each compressed cutaway portion is formed with an orifice opening from the tubular insert. A pressurized fluid source can be selectively connected to one or more of the tubular inserts to provide pressurized fluid for discharge through the orifices. The force of the fluid being discharged through the orifices impacting the rotor fins and rotatably driving the rotors and the shaft to which the rotors are keyed.

3 Claims, 4 Drawing Sheets

FLUID PRESSURE DRIVEN POWER SYSTEM

This invention relates to improvements in a fluid pressure driven power system adapted to be directly coupled to a drive shaft of a rotary mechanism operating under light loads or to be coupled to the drive shaft of a rotary prime mover operating under heavy loads to increase the efficiency of the prime mover and to reduce its power consumption.

BACKGROUND OF THE INVENTION

U.S. Pat. No. 1,280,276 issued to Robert W. Morse on Oct. 19, 1918 is an early example of a system in which an electric motor, as a prime mover for a pump or an air compressor, was coupled to a hydraulic motor which assisted the electric motor in driving the pump or compressor. The primary function of the hydraulic motor was to permit the electric motor when started up to be aided by a powerful torque provided by the hydraulic motor so that the pump or compressor could be quickly brought up to speed without danger of overloading the electric motor or the power line feeding the electric current to the motor.

The system disclosed by Morse was a large, heavy duty, fixed in place installation typical of the era in which it was invented. The hydraulic motor was operable at a relatively low fluid pressure head dependent on the level of water in a water pressure tank. A complicated device was needed for maintaining the hydraulic system in equilibrium to prevent the electric motor being exposed to a heavy overload if the pressure head in the pressure tank was allowed to fall below a certain level. When this happened, the discharge of water to the hydraulic motor impulse wheel from the pressure nozzle would be substantially cut off and the electric driving motor would be exposed to a heavy overload. Conversely, if the pressure nozzle was caused to discharge water to the impulse wheel at a high velocity when the water in the pressure tank reached a higher level , the load would practically all fall on the hydraulic motor which would be detrimental to the efficient operation of the electric motor.

Accordingly, it is an object of the present invention to provide a substantially portable, compact, fluid pressure driven power system. The power system, independently of an uncertain fluid head in a water tank, is operable at easily regulated high fluid pressures from a positive pressure source with the power output of the system being directly related to the fluid pressures over a wide range.

It is yet a further object of the invention to provide a compact fluid pressure driven power system in which the fluid that is pressurized is oil, the oil being held under pressure in a pressure manifold until selectively released from the manifold through one or more conduits each terminating in a discharge orifice aligned with perimeter fins on a finned rotor. The selective application of pressurized fluid as needed through one or more discharge orifices to the perimeter fins on one or more of a plurality of finned rotors mounted on a common shaft provides a mechanism whereby the power output of the system can be precisely regulated and maintained.

It is another object of the present invention to provide an improved fluid pressure driven power system, i.e., a hydraulic motor, that can be coupled to the output shaft of an electric motor to assist the motor in driving a belt and pulley system for operating machinery.

It is yet another object of the present invention to provide an improved fluid pressure driven power system adapted to be the prime mover in a system in which rotatable elements are coupled to and driven directly from the output shaft of the hydraulic power system.

It is yet a further object to of the present invention to provide an improved fluid pressure driven power system that, regardless of the system With which it is used, will increase the efficiency of the system and will cut the power consumption required to operate the system.

These and other objects of the invention will be apparent from the following disclosure of a preferred embodiment of the invention.

SUMMARY OF THE INVENTION

The fluid pressure driven power system comprises a plurality of rotors keyed to a common shaft for conjoint rotation. Each of the rotors has on its perimeter a plurality of upstanding fins adapted to be impacted by high pressure fluid discharged from orifices at the discharge end of fluid pressure tubes each of which is tangentially aligned with a rotor. The highly pressurized fluid, preferably an oil, preferably is selectively supplied to one or more of the fluid pressure tubes from a pressure manifold that has been charged by a gear pump capable of pressurizing the oil to 400 to 2,000 pounds per square inch. The pressurized oil is held in the pressure manifold and released by valves to the desired pressure tube or tubes to cause rotation of the rotors to drive the gear set coupled to an output shaft The fluid pressure power system is provided with accessories such as a water circulating system for controlling the temperature of the pressurized fluid and a fluid filtering system for filtering the fluid of any sediment picked up during operation of the system.

BRIEF DESCRIPTION OF THE DRAWINGS

The invention is best understood with reference to the drawings, in which.

DESCRIPTION OF THE PREFERRED EMBODIMENT

Figure 2:
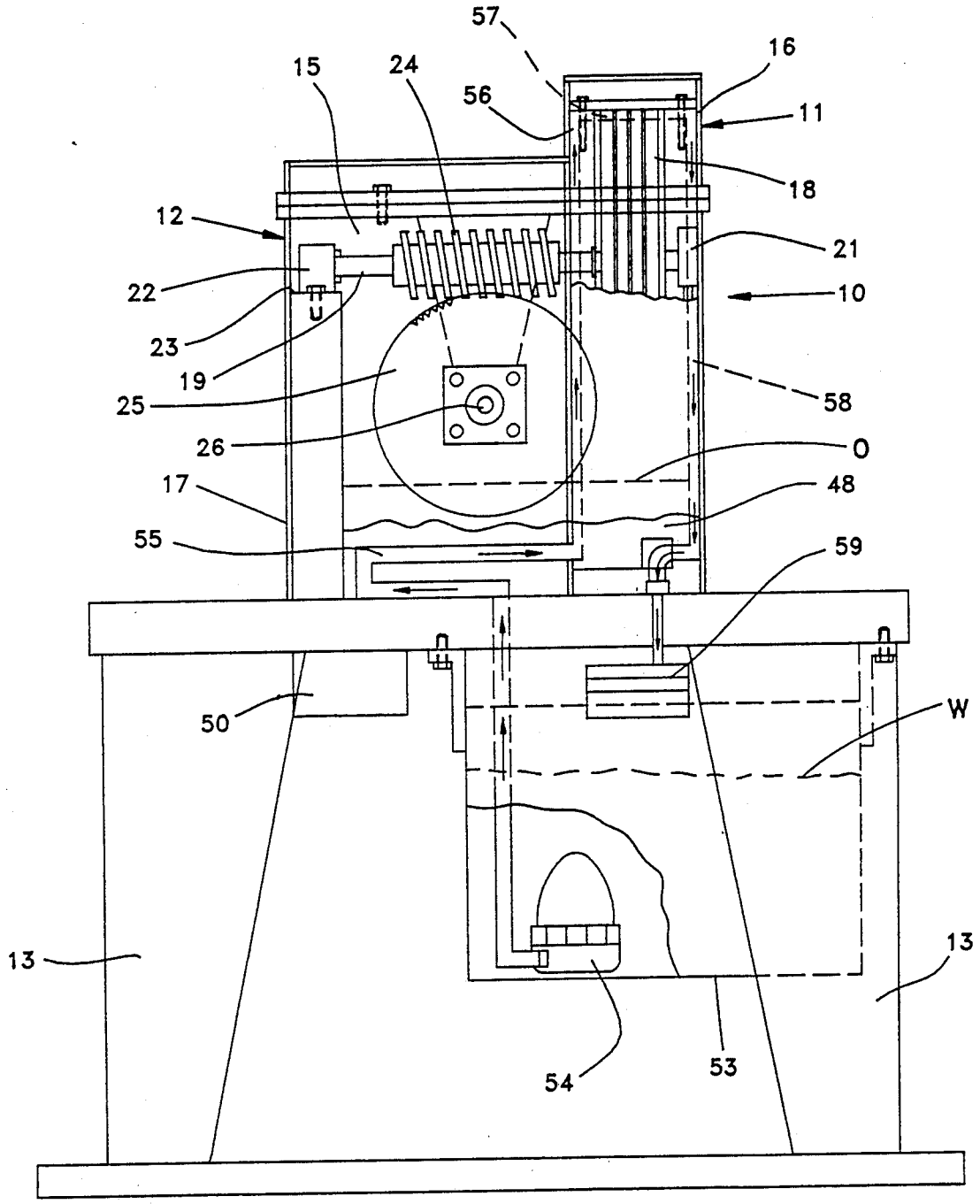
FIG. 2 is a side elevation of the fluid pressure driven power system with a side panel of the upper casing removed to disclose the mechanism housed within the upper casing from a second viewpoint.
Figure 3:
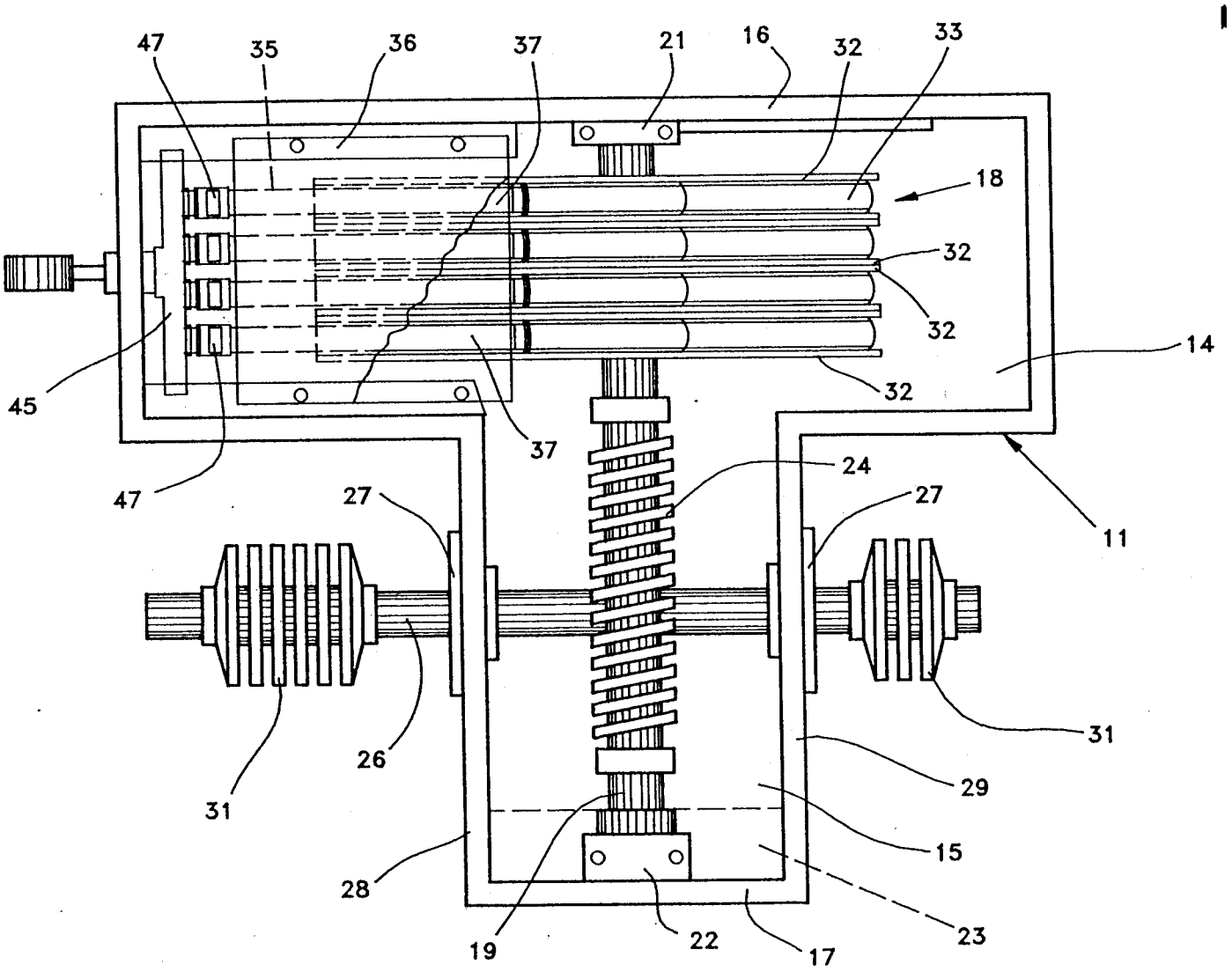
FIG. 3 is a top elevation of the power system with the top panel of the casing removed to reveal the orientation of components of the power system from a viewpoint above the casing.

Referring particularly to the accompanying drawings, the fluid pressure driven system, generally designated 10, comprises a partitioned casing 11 mounted on a platform 12 supported on corner legs 13. When viewed from above as seen in FIG. 3, the casing 11 is substantially "T"-shaped with a partition 14 forming the crossbar of the "T" and a connecting partition 15 forming the leg of the "T". The partition 14 extends across the rear of the casing 11 for the width of the latter parallel to the casing rear face 16. The partition 15 forming the leg of the "T" is located midway of the ends of the partition 14 and extends forwardly to the front wall 17 of the casing partition 15. As best seen in FIG. 2, partition 14 of the casing extends above the top of the partition 15 to accommodate the upper ends of a plurality of rotors 18.

The rotors 18, of which there are preferably four, are keyed for conjoint rotation on a common shaft 19. As best seen in FIG. 3, the shaft 19 extends from a bearing 21 mounted on the rear wall 16 of the casing 11 to the front wall 17 of the partition 15. The end of the shaft 19 adjacent the wall 17 is journaled in a pillow block bearing 22 mounted on a support shelf 23.

The rotors 18 are mounted on the portion of the shaft 19 contained within the partition 14 of the casing 11. Keyed to shaft 19 within the partition 15 is a worm 24. The worm 24 is in mesh with a worm wheel or gear 25. The worm wheel 25 is keyed to a cross shaft 26 journaled in bearings 27 in the partition 15 sidewalls 28–29. The shaft 26 end portions projecting externally of the casing partition 15 are adapted to receive pulleys 31 to which belts (not shown) for transmitting power to remote shafting can be attached.

Rotation of the shaft 26 carrying the pulleys 31 is the end result of the rotation of the rotors 18. The rotors 18 are adapted to be rotatably driven by pressurized fluid streams impacting modified buckets mounted on the perimeters of the rotors.

Figure 6:
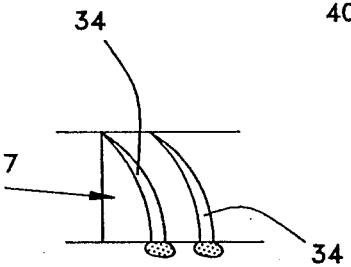
FIG. 6 is an enlarged side elevation of a pair of adjacent fins on the perimeter of the rotor.
Figure 8:
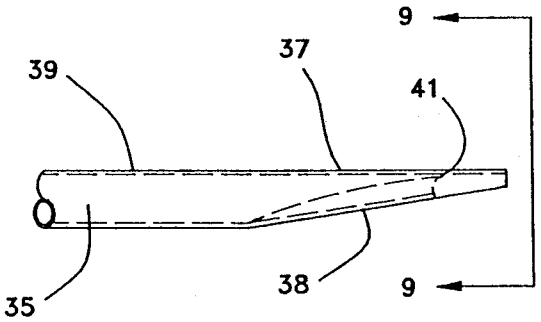
FIG. 8 is an enlarged side view of the end portion of the orifice containing end of a tubular insert through which pressurized fluid is directed toward the rotor fins.

More specifically, each rotor 18 has axially spaced, relatively thin, side disks 32 with a center disk 33 of greater thickness sandwiched therebetween. The diameter of the side disks 32 is slightly greater than the diameter of the center disk 33. The center disk 33 provides a base for closely spaced concavely curved fins 34 that encircle the perimeter of the center disk. The fins 34 each have a cross section shown in FIG. 6.

Figure 5:
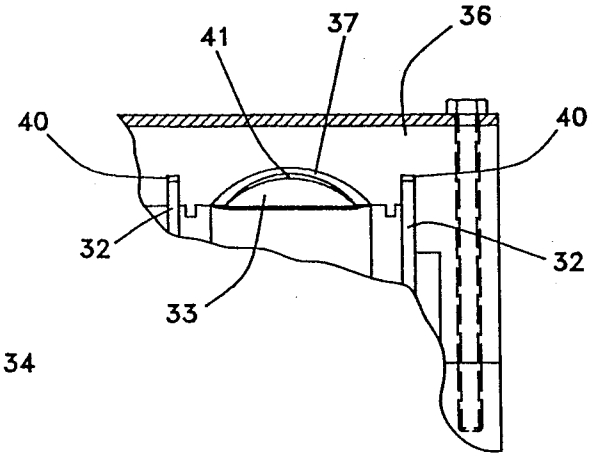
FIG. 5 is an enlarged cross section taken on the line 5—5 looking in the direction of the arrows.

The pressurized fluid, which preferably is oil, is delivered to each rotor 18 through high pressure tubes 35, preferably made of stainless steel. The tubes 35 are partially embedded in an aluminum pressure head 36 that is bolted in place above the rotors 18 but below the top of the partition 14 containing the rotors. The pressure head 36 spans the width of the casing partition 16 containing the rotors 18. As shown in FIG. 5, the disk sides 32 project into grooves 40 on the underside of the pressure head 36. This relationship is repeated across the width of the partition.

Figure 1:
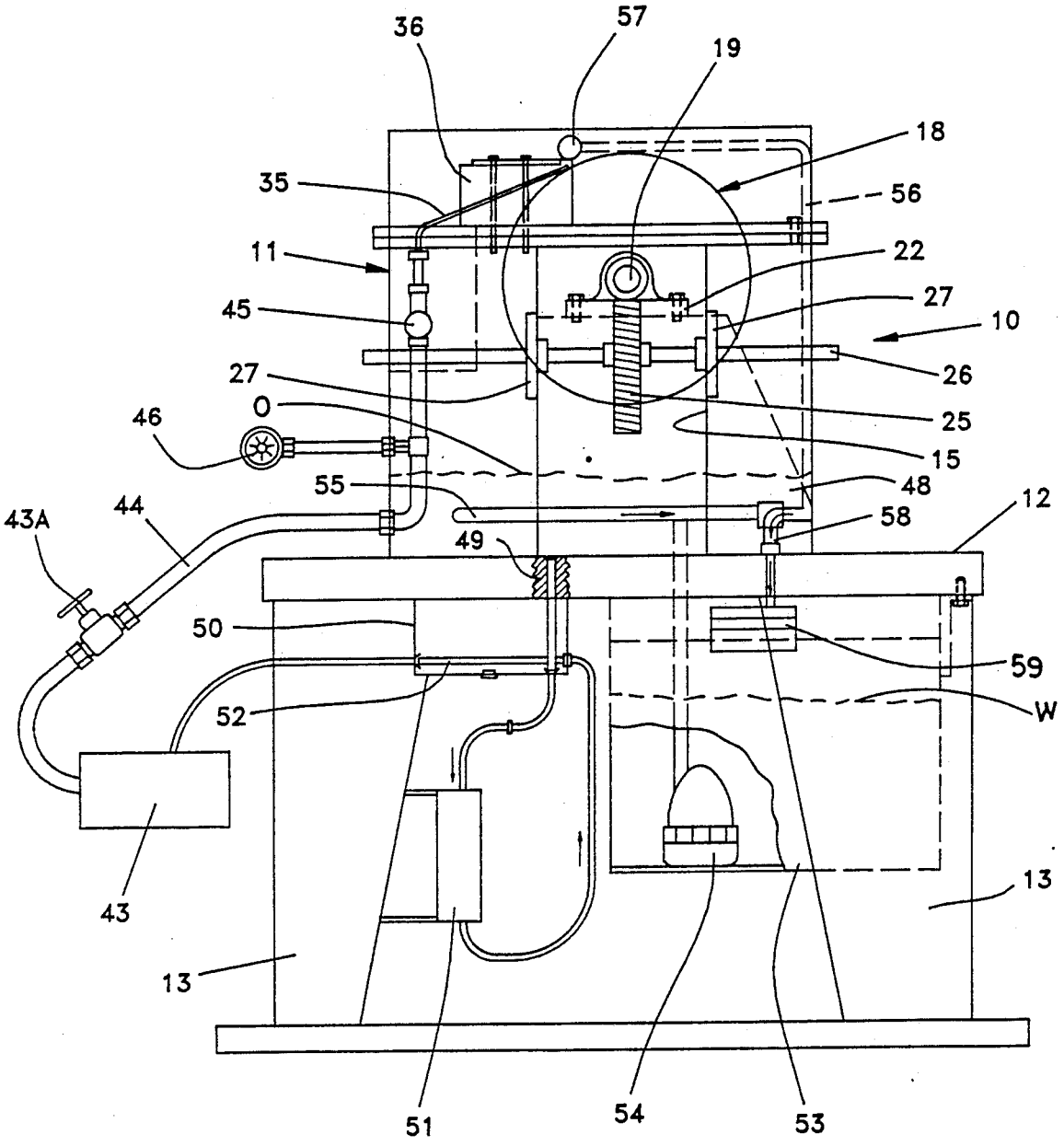
FIG. 1 is a front elevation of the fluid pressure driven power system with a front panel of the upper casing removed to disclose the mechanism housed within the casing.
Figure 4:
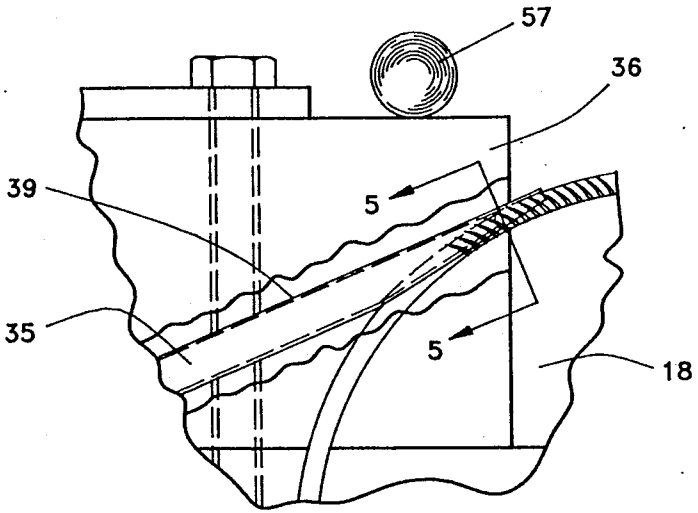
FIG. 4 is a fragmentary side view of a power system rotor illustrating the orientation of rotor fins on the rotor perimeter relative to a tubular insert having an orifice through which pressurized fluid is directed against the fins to cause rotation of the power system rotor.
Figure 7:
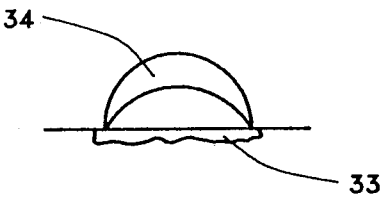
FIG. 7 is an enlarged view of a fin taken the direction of the arrow 7 of FIG. 6.

As best seen in FIGS. 1 and 4, each tube end portion 37 is positioned in the pressure head 36 at an upwardly inclined angle that is substantially tangential to the perimeter of the rotor 18 with which it is aligned.

Figure 9:
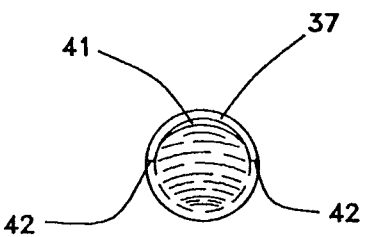
FIG. 9 is a cross sectional view of the tubular insert taken substantially on the line 9—9 of FIG. 8 looking in the direction of the arrows.

The fluid pressure discharge end 38 of each tube end portion 37 is arcuately depressed toward what in installed position of the tube is the top side 39. As best seen in FIG. 9, the discharge end has a double wall thickness at the center of which is an arcuate opening that becomes an orifice 41 through which high pressure fluid can be discharged to impact the fins 34 on a rotor 18. The span across the ends 42 of the discharge end 38 is critical to the extent that it must precisely fit between the side disks 32 of each rotor 18 so that no fluid is allowed to pass through the rotor without reacting fully on the fins 34. The inner radius of curvature of the depressed end portion 38 is also critical to the extent that the fins 34 must be able to pass beneath the discharge orifice 41 end of the pressure tube without interference but at a minimal clearance.

With reference to FIG. 1, the fluid circuit for pressurizing the oil for rotatably driving the rotors is as follows:

The circuit comprises a motor driven gear pump 43 capable of providing oil pressure in the range of 400 to 2000 pounds per square inch. The pressurized oil is pumped through a conduit 44 to a pressure manifold 45. The volume of oil and its pressure flowing through the conduit 44 is controlled by a manually operable throttle valve 43*a*. A pressure gauge 46 tapped into the conduit 44 is provided to so that the system operator can be aware of the pressure output of the pump. From the pressure manifold 45 the pressurized oil can selectively directed through valves 47 to any one or more of the pressure tubes 35 leading to any one or all of the orifices 41 aligned with the respective rotors 18. The valves 47 preferably two position valves that are in an opened or closed position depending on which ones and how many of the rotors are to be used in driving the shaft 26. The velocity of the rotors 18 and the power and torque output of the worm and gear set 24-25 is directly responsive to the pressure output of the gear pump 43 and the distribution of the pressurized oil from the pressure manifold 45.

The oil after impacting the fins 34 of the rotors 18 is carried down around the rotors and drops into a tank or reservoir 48 at the bottom of the casing partitions 14 and 15. The oil "O" in the tank or reservoir 48 is drained through a metered drain 48 into a sump 50 beneath the platform 12 from which it is piped through a filter and pump 51 and returned through a conduit 52 in the sump to the suction side of the gear pump 43 for recycling through the system.

Provision is made for bypassing the oil filter if the latter becomes clogged. Should this happen the oil will be permitted to drain directly into the sump 50 from which it then may be drawn directly into the gear pump suction line.

The pressurization of the oil by the gear pump 43, the friction of the oil through the conduits to and from the pressure manifold and the discharge of the oil to the orifices all tend to increase the temperature and thereby to decrease the viscosity of the oil. To stabilize the temperature of the oil flowing through the system, a water tank 53 is suspended beneath the platform 12. The tank contains a submerged water pump 54 for circulating water "W" from the tank through water pipes 55 submerged in the oil in the reservoir. A branch 56 is routed u the inner side wall of the casing to a pipe 57 going across the top of the pressure head 36. The pressure head 57 communicates with a pipe 58 that goes down a side wall of the casing and through the platform 12 into a water cooling evaporator pads 59 and then back into the water tank 53 for recycling.

It will readily apparent, however, that for light loads the fluid pressure driven power system shaft 26 could be directly coupled to the input shaft of a machine or rotatable element implement rather than having its power transmitted through a pulley belt system as might be required for heavy load or multiple drive systems.

While the invention has been illustrated with respect to a specific embodiment thereof, this embodiment should be considered illustrative rather than limiting. Various modifications and additions may be made and will be apparent to those skilled in the art. Accordingly, the invention should not be limited by the foregoing description, but rather should be defined only by the following claims.

I claim:

1. A fluid pressure driven power system, comprising:

a platform on which a casing is mounted, a plurality of side by side rotors within the casing keyed for conjoint rotation to a common shaft, each rotor having axially spaced side disks with the space therebetween spanned by radial fins extending above the perimeters of the rotors, a pressure head mounted within the casing above the rotors, a plurality of tubular inserts embedded within the pressure head each having an exposed end portion, each tubular insert being aligned with a rotor and having on its exposed end portion a concavely curved cutaway section adapted to tangentially overlie rotor fins therebeneath, the side disks on each rotor being spaced to closely fit the width of the tubular insert exposed end cutaway section overlying the fins and having perimetral edge portions projecting into upwardly extending slots in the pressure head to provide a chamber between the side disks above the rotor, the concavely curved cutaway sections each having an orifice therebeneath through which pressurized fluid is discharged in a direction to impact the rotor fins to cause rotor rotation, a source of highly pressurized fluid selectively connectable to one or more of the tubular inserts to provide pressurized fluid for discharge through the orifices, wherein the fluid being discharged through an orifice to impact the rotor fins aligned therewith will be restricted to the chamber above the rotor to minimize loss of fluid and pressure of the pressurized fluid emanating from the orifices.

2. A fluid pressure driven power system according to claim 1 in which:

the fluid after having been applied through an orifice to a selected rotor is recaptured in a reservoir in the casing below the rotors, a coolant tank containing a submergible water pump is mounted on the underside of the platform, conduit means are connected to the discharge side of the coolant pump, the conduit means having branches submerged within fluid in the fluid reservoir, extending around interior walls of the casing and over the pressure head, whereby coolant circulated through the conduit means dissipates the heat generated by the high pressure fluid as the latter is supplied to the tubular inserts and forced through the orifices to impact rotor fins.

3. In an improved fluid pressure driven power system having a plurality of rotors keyed to a shaft rotatably journaled within a casing, the casing having a first and a second partition, and a removably top covering both partitions, the rotors being housed within the first partition, each rotor having a plurality of fins extending around its periphery with the fins projecting above the perimeter of the rotor, the improvement comprising a pressure head mounted within the first partition beneath the removable top, a plurality of tubular inserts embedded in the pressure head, each of the tubular inserts having an exposed longitudinal end portion in tangential alignment with the fins on a rotor, each end portion having a cutaway section that is upwardly arcuately compressed to overlie the fins on rotors rotating beneath the pressure head, each compressed cutaway section being formed with an orifice opening from the tubular insert, and a pressurized fluid source that can be selectively connected to one or more of the tubular inserts to provide pressurized fluid for discharge through the orifices, the force of the fluid being discharged through the orifices impacting the rotor fins rotatably driving the rotors and the shaft to which the latter are keyed, the fluid after having impacted on the rotor fins is recaptured in a reservoir below the rotors, a coolant tank is mounted below the casing, a coolant pump mounted within the water tank is operable to supply coolant through a pipe system having serpentine sections submerged within the fluid reservoir and further sections extending around the casing walls and over the pressure head, whereby coolant circulated through the pipe sections is effective to dissipate the heat generated in the high pressure fluid during its pressurization and as it is forced through the orifices.

* * * * *